US005201789A

United States Patent [19]

Fontana

[11] Patent Number: 5,201,789

[45] Date of Patent: Apr. 13, 1993

[54] WOVEN METAL BAND IN PARTICULAR FOR WATCHES INCORPORATING REMOVABLE AND JOINTED LINKS

[75] Inventor: Fernando Fontana, Sesto Calende, Italy

[73] Assignee: G.T.F. S.r.l., Sesto Calende, Italy

[21] Appl. No.: 855,292

[22] Filed: Mar. 23, 1992

[30] Foreign Application Priority Data

Dec. 23, 1991 [IT] Italy ..... MI91A003450

[51] Int. Cl.[5] ..... F16G 13/00

[52] U.S. Cl. ..... 59/80; 59/83; 63/4

[58] Field of Search ..... 59/78, 80, 82, 83, 85, 59/92; 245/6; 63/4

[56] References Cited

U.S. PATENT DOCUMENTS

| | | | |
|---|---|---|---|
| 2,451,750 | 10/1948 | Kreisler et al. | 63/4 |
| 3,263,799 | 8/1966 | Bascom et al. | 245/6 |
| 4,627,231 | 12/1986 | Kiuchi | 59/80 |

FOREIGN PATENT DOCUMENTS

| | | | |
|---|---|---|---|
| 18895 | 8/1904 | Austria | 59/80 |
| 2500980 | 7/1976 | Fed. Rep. of Germany | 59/80 |
| 2512531 | 9/1976 | Fed. Rep. of Germany | 59/80 |

*Primary Examiner*—David Jones
*Attorney, Agent, or Firm*—Bucknam and Archer

[57] ABSTRACT

The band consists of a plurality of links (20), (22) formed by bringing together four turns (12*a*), (12*b*), (12*c*) and (12*d*) constrained together by means of pins or equivalent elements inserted in the substantially cylindrical seat which said turns create by partial reciprocal penetration. At least one of said turns and preferably the fourth turn of each link is provided on one side with internal threading into which screws the end (18') of the screw (18) constituting the means of connection between two links (20), (22) and is arranged between the side blocks (30). An alternative form of execution provides that to the branches (42) and/or (44) of the band (40) are connected one or more segments (52) made of metal fabric similarly to the band itself. Said connection is provided by pins inserted in the tubes (54) formed by tube sections (54'), (54''), (54''').

8 Claims, 3 Drawing Sheets

Figure 3:
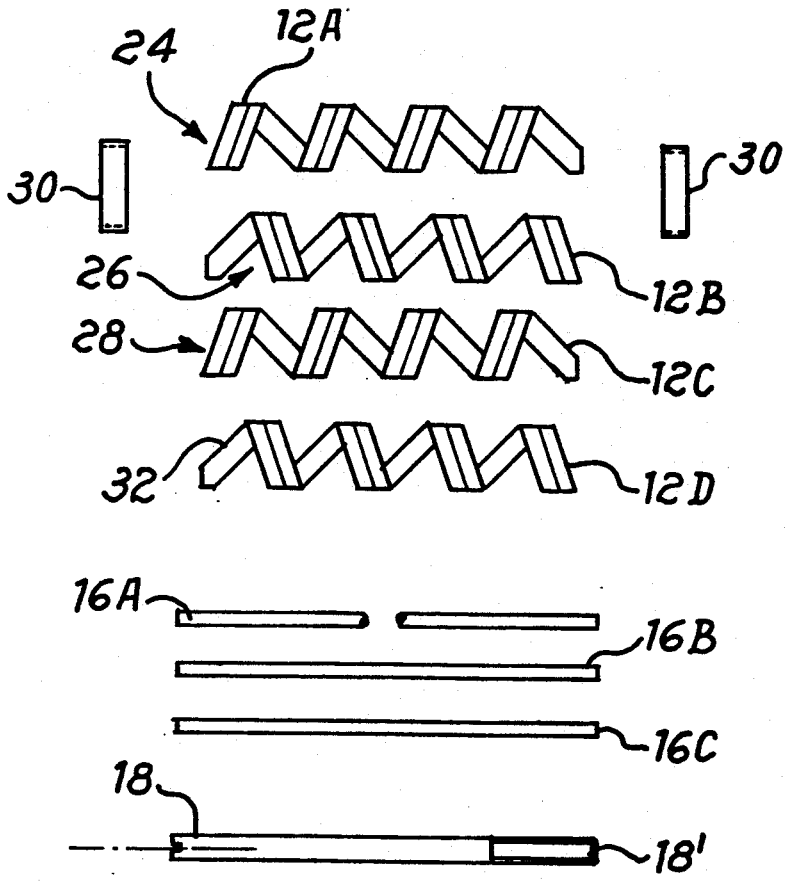

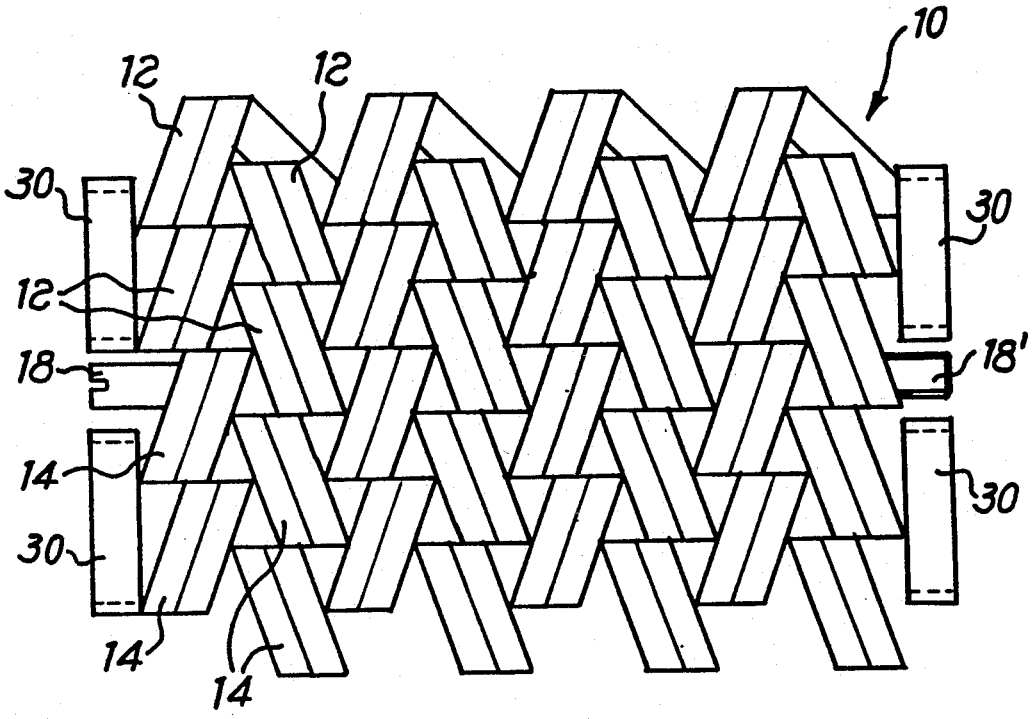
Fig. 1
Fig. 2
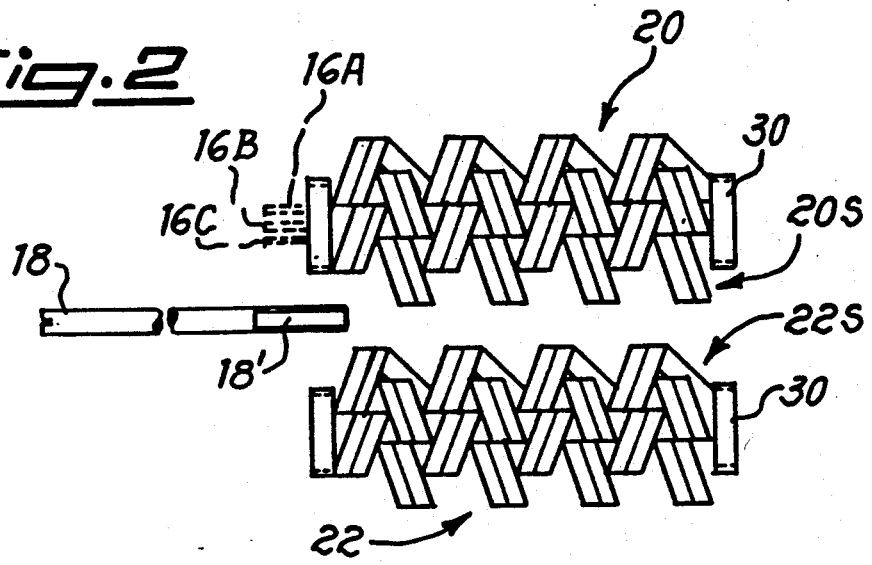

WOVEN METAL BAND IN PARTICULAR FOR WATCHES INCORPORATING REMOVABLE AND JOINTED LINKS

DESCRIPTION

The present invention relates to a woven metal band in particular for watches incorporating removable and jointed links.

Wrist watches are conventionally provided with elements for constraint to the wrist consisting of skin, leather or plastic straps or metal bands. The latter are generally made up of opposing branches which, being constrained to the watch case, have free ends provided with closing devices of various types or ends connected to an intermediate frame to provide closing of the so-called pocket-book type.

In more valuable products there are usually adopted metal bands which, being made of gold or other precious metals the same as the case, contribute considerably to increase the value of the product. Said bands, beyond the value due to the use of valuable materials, usually offer refined workmanship and design.

In the framework of these creations it is possible to identify different types which relate substantially to the structure of the articles. Besides the widespread bands consisting of jointed links there are bands with curved laminations, i.e. formed of strips of woven metal. These are alternative solutions which, while being substantially different from each other, always lead to the creation of valuable bands, each time matched with the watches on the basis of appearance or size.

These articles, as is known, must satisfy the basic requirement of accurately fitting the wrist, whose size can vary considerably from one person to another. In woven metal bands in particular this requirement is at the origin of considerable difficulties because sometimes the alternative connecting seats provided on the closing device are insufficient, i.e. it is not possible to replace said device with another, more suitable, one. On the other hand the woven metal band does not allow easy shortening and lengthening because its braided structure requires skilled personnel. For example, if it is necessary to lengthen one or both branches it is necessary to cut, shorten to measure and then weld the band with great accuracy, especially at the cut made, to fix all the wires making up the fabric and avoid the danger of unravelling.

The reverse operation of lengthening is still more complicated and risky because there has to be fitted a new section of metal fabric, if possible invisibly. This operation is generally done directly by the band manufacturer who, in the most difficult cases, replaces the branch or branches.

The purpose of the present invention is to obviate the above mentioned problems.

The present invention as basically characterized in the claims solves the problem of creating a woven metal band applicable in particular to watches in which the number of turns is easy to change because said turns incorporate screws or equivalent fastening members, removable if necessary to open the branch of the band and insert or remove one or more elements.

The advantages achieved by the present invention consist essentially of the fact that the band is lengthened or shortened to measure by simple adjustments without cuts, welds or unsightly deposits. The fitting operations, given the structure of the band, do not require the use of complicated equipment or the direct intervention of the original manufacturer.

Figure 4:
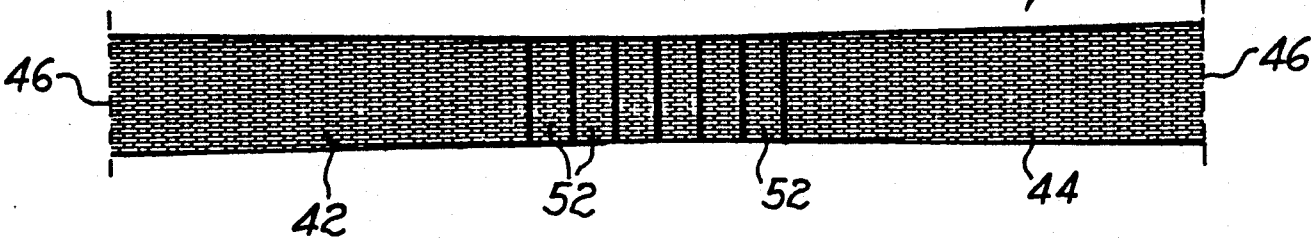
Figure 5:
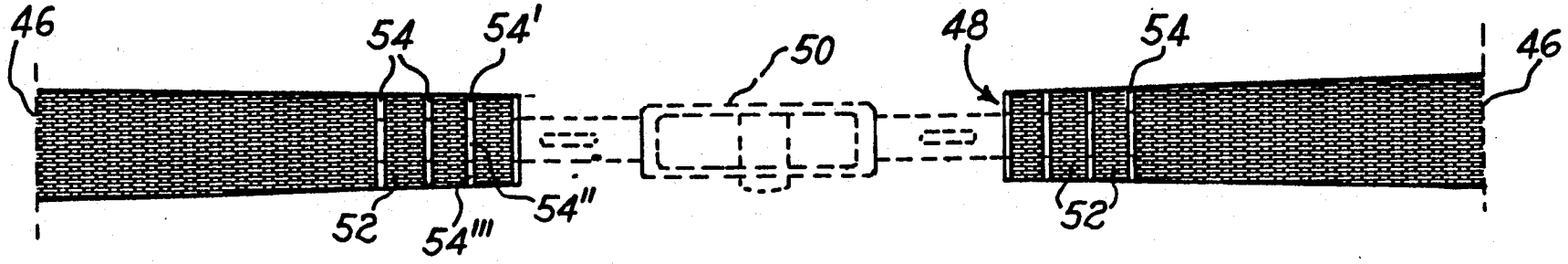

Said fitting operations and additional specific characteristics of the present invention will be clarified in the detailed description given below of a preferred and nonlimiting form of embodiment of the metal band in accordance with the present invention given with reference to the annexed drawings wherein:

FIG. 1 shows a schematic plan view of two assembled links of the band with associated screw in its seat and each consisting of four reciprocally constrained turns, FIG. 2 shows a schematic plan view of the links of FIG. 1 separated from each other with connecting screws not housed in their seats, FIG. 3 shows schematically the elements making up the individual links of the bracelet, FIG. 4 shows schematically a plan view of the band in accordance with an alternative form of embodiment, and FIG. 5 shows schematically a plan view on the inside of the band of the previous figure proposed in fully open condition.

With reference to the above mentioned figures the woven metal band indicated as a whole by reference number 10 in FIG. 1 consists of a plurality of conventional metal turns 12, 14 constrained together to form link assemblies. Each link consists in accordance with a preferred and nonlimiting form of embodiment of four identical turns indicated by reference number 12*a*, 12*b*, 12*c* and 12*d* of FIG. 3 where they are shown separately.

Each group of turns, constrained together by pins indicated by reference numbers 16*a*, 16*b*, 16*c* forms all together the link indicated by 20 or 22 in FIG. 2.

These turns, brought together in such a manner as to penetrate reciprocally, form substantially cylindrical seats in which are fitted the above mentioned pins. For example the pin 16*a* is inserted, by way of example starting from the side 24, in the turn 12*a* previously brought near the turn 12*b*. The pin 16*a* consequently provides the constraint between the above turns, emerging from the opposite side. Similarly, the pin 16*b* constrains the turn 12*b*, with which is already integral the turn 12*a*, to the turn 12*c* entering from the side 26. The pin 16*c* is inserted from the side 28 and provides the constraint of the four turns. The pins 16*a*, 16*b* and 16*c* emerging from the opposing heads are then cut flush with the collar 30 or side block fitted thereon and then are welded with weld material which goes to form the outer wall of said block.

The links 20 or 22 thus obtained constitute as many elements or segments of the metal band and are constrained together as explained below.

In accordance with the present invention the turn 12*d* is advantageously provided on one side with internal threading in which is screwed the end 18' of the screw 18. Said threading is not shown but is preferably provided even with the internal portion of the last segment 32 of the fourth turn 12*d*. The screw 18 constitutes therefore the means of connection between two links, such as for example the links 20 and 22, each of which is made up of four turns as illustrated above. With reference to FIG. 2 the mentioned screw is inserted in the substantially cylindrical seat formed for example by the drawing together of the fourth turn 20*s* of the link 20 with the first turn 22*s* of the link 22, as in FIG. 2.

After completion of the constraint said links are arranged as in FIG. 1 in which they are made up of the turns 12 and 14. The screw 18 arranged between the side blocks 30 which incorporate the opposed ends of the pins 16*a*, 16*b* and 16*c*, given its own small diametric cross section, does not appear clearly.

Said screw also constitutes the joint element between the links 20 and 22 which can consequently arrange themselves angularly to follow adequately the form of the wrist.

The connection by screws 18 of a plurality of links of the type 20, 22 leads to the formation of the branches of the band which, at the free ends, are provided with suitable closing devices of known type. The band provided in this manner can if necessary be readily lengthened or shortened without cutting and/or welding which would damage its appearance. For this purpose, indeed, it is sufficient to unscrew and withdraw from the corresponding turn one of the screws 18 which connect together the multiple links 20, 22 of one of the branches of the band to separate said branch in two sections. The different turns 12 or 14 which form each of the links 20 and 22 previously coupled together by means of pins 16*a*, 16*b* and 16*c* cannot unravel. After separation, between the sections of the band branch is inserted another link 20 or 22 connected to the end of said sections by means of two screws 18 whose threaded ends 18' are inserted in the threaded seat of the existing fourth turn integral with the link 20 or 22 and in the analogous seat in the fourth turn of the link just added respectively.

There is provided in this manner lengthening of the band branch for an amount corresponding to the length of the added link If said lengthening is insufficient the same operation of insertion of a link 20 or 22 is performed by the same procedure on the opposite branch of the band also. Greater lengthening is of course possible by inserting a greater number of links 20 or 22 in one or both of the branches.

Conversely, reduction of the length of the band is achieved by removal of one or more links 20, 22 from one or both of the branches of the band.

FIGS. 4 and 5 refer to an alternative form of embodiment of the metal band in accordance with the present invention. Said FIGS. show a metal band indicated as a whole by 40 in FIG. 4 and consisting of the branches 42 and 44. The ends 46 of each of said branches are connected by known means to the watch case (not shown) while the end 48 of the branches is constrained to a generic closing device 50 shown schematically in broken lines in FIG. 5 and not described in detail because irrelevant to the present invention.

With particular reference to FIG. 5 each of the branches 42 and 44 of the band 40 displays even with the portion near the ends 48 some segments 52 extended in a limited manner. Said segments are provided of metal fabric similarly to the remaining and more extended portion of each of the branches 42 and 44 and are connected together as well as to said branches and to the closing device 50 in a jointed manner. Said connection is provided through screws, pins or the like inserted in the tubes 54 formed by the alignment of three tube sections 54', 54'' and 54'' , shown in FIG. 5. Said tube sections are provided preferably in the same material making up the branches 42 and 44 of the band 40 and are appropriately conformed and are constrained to the segments 52 or to the branches or to the closing device 50 on the internal side which comes in contact with the wrist.

In accordance with a preferred embodiment the tube sections 54', 54'' and 54''' are constrained to the corresponding segments or to the branches 42, 44 or to the device 50 in accordance with a design which calls for two tube sections at the end of a segment 52 and one tube arranged in a central position on the adjacent element. The branch 42 or 44 of the band 40 can therefore if necessary be rapidly and easily shortened or lengthened. These operations require removal of the screw or pin from one of the tubes 54 and then constraint of the two parts of the branch after elimination or addition of one or more segments 52. The latter are arranged even with the closing deice 50 and make the sections of interruption between them scarcely visible while the tubes 54 are arranged only on the internal side which comes in contact with the wrist and are invisible.

As may be seen from the foregoing the advantages of the present invention are clear.

The metal band is readily adaptable to the size of the wrist and said adaptation does not require cutting of the branches of the band and ensuing welding. Insertion of one or more links in one or both of the band branches does not affect the appearance of the band.

The alternative design proposed is usable in particular for bands consisting of metal turns having small cross section and allows in an equally rapid and easy manner adaptation of the band to the form of the wrist.

The invention as described above and claimed below is proposed merely by way of example and it is understood that it can be subjected to numerous modifications and variations all falling within the scope of the inventive concept.

For example the links making up the band or the links added thereto can consist of a greater or smaller number of turns reciprocally constrained by pins welded on the heads and delimited by the side blocks while the screws which constrain between them said links can be replaced by rivetted pins or equivalent retaining means. Each of said turns can also consist of several turns aligned longitudinally with optionally variable cross section and made of different materials and/or have different surface finish.

Lastly, it is intended that the woven metal arm-brand, although proposed in particular for wrist watches, can also be associated with different articles such as for example jewels and the like or proposed separately in the form of a bracelet.

We claim:

1. A woven metal band for watches and bracelets consisting of a plurality of links (20)(22), each link being formed by at least two turns (12,14), said turns being juxtaposed, partially penetrating each other and forming cylindrical seats, and pins (16*a*), (16*b*), (16*c*), said pins being inserted into said cylindrical seats, at least one of said turns having threads in the interior thereof, a screw (18) having a threaded end (18'), said threaded end being inserted into said turn which has threads in the interior thereof, said screw connecting two links.

2. The band according to claim 1 which consists of four turns (12*a*), (12*b*), (12*c*), (12*d*), each link has side blocks at both ends and said pins are welded to said side blocks.

3. The metal band according to claim 1 wherein each of the turns (12), (14) consists of two or more turns having different cross section brought together longitudinally.

4. The band according to claim 1 which consists of two branches (42)(44) and a closing device (50), each branch having an end (48) connected to said closing device, an opposite end (46) connected to the watch case, which further comprises one or more segments (52) made of woven metal, a tube (54) on at least one side of each of said segments, and a pin housed in said tube.

5. The metal band according to claim 4 wherein said segments (52) are arranged at the end of the branches (42), (44) near said closing device (50).

6. The band according to claim 14 which comprises two tubes (54) and said tubes are made in sections (54', 54'', 54''').

7. A woven metal band for watches and bracelets consisting of a plurality of links (20)(22), each link being formed by at least two turns (12,14), said turns being juxtaposed, partially penetrating each other and forming cylindrical seats, and pins (16*a*), (16*b*), (16*c*), said pins being inserted into said cylindrical seats, and riveted blocks, said riveted blocks connecting said links.

8. The metal band according to claim 7 wherein each of the turns (12), (14) consists of two or more turns having different cross section brought together longitudinally.

* * * * *